US011749207B2

(12) United States Patent
Shin et al.

(10) Patent No.: US 11,749,207 B2
(45) Date of Patent: Sep. 5, 2023

(54) GATE DRIVING CIRCUIT AND DISPLAY DEVICE INCLUDING 1HE SAME

(71) Applicant: LG Display Co., Ltd., Seoul (KR)

(72) Inventors: Yeon Woo Shin, Paju-si (KR); Jae Sung Yu, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/894,013

(22) Filed: Aug. 23, 2022

(65) Prior Publication Data

US 2023/0110320 A1 Apr. 13, 2023

(30) Foreign Application Priority Data

Oct. 8, 2021 (KR) ..... 10-2021-0133835
Dec. 10, 2021 (KR) ..... 10-2021-0176375

(51) Int. Cl.
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2310/0286* (2013.01); *G09G 2310/0291* (2013.01); *G09G 2310/08* (2013.01); *G09G 2320/043* (2013.01); *G09G 2330/021* (2013.01); *G09G 2354/00* (2013.01)

(58) Field of Classification Search
CPC ..... G09G 3/3266; G09G 3/3233; G09G 2310/0286; G09G 2310/0291; G09G 2310/08; G09G 2320/043; G09G 2330/021; G09G 2354/00
See application file for complete search history.

(56) References Cited

U.S. PATENT DOCUMENTS

2013/0077736 A1* 3/2013 Son ..... G09G 3/2085 377/64
2018/0151606 A1* 5/2018 Park ..... H01L 27/1248

FOREIGN PATENT DOCUMENTS

KR 10-2013-0032532 A 4/2013
KR 10-2017-0081801 A 7/2017
KR 10-2019-0081075 A 7/2019

* cited by examiner

*Primary Examiner* — Stacy Khoo
(74) *Attorney, Agent, or Firm* — Birch, Stewart, Kolasch & Birch, LLP

(57) ABSTRACT

A gate driving circuit and a display device including the same are discussed. A signal transmitter of the gate driving circuit can include a first charge controller configured to charge a first control node in response to a voltage of a VST node, a second charge controller configured to charge a second control node using a first transistor that is turned on in response to an (N+1)th clock generated following an Nth clock, a first discharge controller configured to discharge the first control node in a charging period of the second control node, and a second discharge controller configured to discharge the second control node when the voltage of the VST node is a high voltage or in a charging period of the first control node.

15 Claims, 12 Drawing Sheets

GATE DRIVING CIRCUIT AND DISPLAY DEVICE INCLUDING 1HE SAME

CROSS-REFERENCE TO RELATED APPLICATION

This application claims priority to and the benefit of Korean Patent Application No. 10-2021-0133835, filed on Oct. 8, 2021 in the Republic of Korea, and Korean Patent Application No. 10-2021-0176375, filed on Dec. 10, 2021 in the Republic of Korea, the entire contents of all these applications being hereby expressly incorporated by reference into the present application.

BACKGROUND

1. Field

The present disclosure relates to a gate driving circuit and a display device including the same.

2. Discussion of Related Art

Electroluminescence display devices can be divided into inorganic light-emitting display devices and organic light-emitting displays according to a material of an emission layer. An active matrix organic light-emitting display device includes an organic light-emitting diode (OLED) that generates light by itself and has advantages in terms of a high response rate, high luminous efficiency, high brightness, and a large viewing angle.

In an organic light-emitting display device, an OLED is formed at each pixel. The organic light-emitting display device has a high response rate, high luminous efficiency, high brightness, and a large viewing angle and is capable of expressing black gradation in perfect black, thereby achieving a high contrast ratio and a high color reproduction rate.

A pixel circuit of an organic light-emitting display device includes a light-emitting element, a driving element for driving the light-emitting element, and one or more switch elements. The switch elements are turned on or off according to a gate voltage to connect or disconnect main nodes of the pixel circuit. The drive element and the switch elements can be embodied together as a transistor.

Gate driving circuits generate gate pulses to be applied to gate electrodes of switch elements constituting a pixel circuit to control the switch elements. Since such a gate driving circuit is composed of many transistors, the bezel area of a display panel can increase when it is disposed on the substrate of the display panel.

SUMMARY OF THE DISCLOSURE

The present disclosure has been made in an effort to address aforementioned necessities and/or drawbacks.

The present disclosures provides a gate driving circuit capable of reducing a bezel area of a display panel, and a display device including the same.

In addition, when the number of transistors in the gate driving circuit is reduced in order to reduce the bezel area of the display panel, an unwanted output or leakage current can occur, thereby increasing power consumption. Thus, the present disclosures also provides a gate driving circuit capable of reducing a bezel area of a display panel while preventing a leakage current, and a display device including the same.

The problems and limitations to be solved or addressed by the present disclosure are not limited to those mentioned above, and other problems or limitations not mentioned will be clearly understood by those skilled in the art from the following description.

A gate driving circuit according to an embodiment of the present disclosure can include a shift register including signal transmitters configured to receive a start pulse and a shift clock and connected in a cascade structure to sequentially generate a gate pulse.

According to an embodiment of the present disclosure, an Nth (e.g., N is a positive integer) signal transmitter of a gate driving circuit usable in a display device can include a VST node to which the start pulse or a carry signal from a preceding signal transmitter is applied, one or more CLK nodes to which the shift clock is inputted, a VDD node to which a high-potential driving voltage is applied, a VSS node to which a low-potential reference voltage is applied, a first control node configured to control a first pull-up transistor, a second control node configured to control a first pull-down transistor, a first charge controller configured to charge the first control node in response to the voltage of the VST node, a second charge controller configured to charge the second control node using a first transistor that is turned on in response to an (N+1)th clock generated following an Nth clock, a first discharge controller configured to discharge the first control node in a charging period of the second control node, and a second discharge controller configured to discharge the second control node when the voltage of the VST node is a high voltage or during a charging period of the first control node.

A display device of the present disclosure can include the gate driving circuit.

A display device according to an embodiment of the present disclosure can include a display panel including data lines to which a data voltage is applied, gate lines crossing the plurality of data lines and to which a gate signal is applied, pixels connected to power lines, and a gate driving circuit configured to supply a gate pulse to the gate lines, wherein a shift register of the gate driving circuit includes signal transmitters configured to receive a start pulse and a shift clock and connected in a cascade structure. An Nth signal transmitter among the signal transmitters can include a signal node (e.g., VST node) to which the start pulse or a carry signal from a preceding signal transmitter is applied, one or more shift clock nodes (e.g., CLK nodes) to which the shift clock is inputted, a first voltage node (e.g., VDD node) to which a high-potential driving voltage is applied, a second voltage node (e.g., VSS node) to which a low-potential reference voltage is applied, a first control node configured to control a first pull-up transistor, a second control node configured to control a first pull-down transistor, a first charge controller configured to charge the first control node in response to the voltage of the signal node, a second charge controller configured to charge the second control node using a first transistor that is turned on in response to an (N+1)th clock generated following an Nth clock, a first discharge controller configured to discharge the first control node in a charging period of the second control node, and a second discharge controller configured to discharge the second control node when the voltage of the signal node is a high voltage or in a charging period of the first control node, where N is a positive integer.

According to the present disclosure, the configuration of the charge controller can be reduced or minimized by integrating transistors for inducing charging of the second control node that controls a pull-down transistor and discharging of the first control node that controls a pull-up transistor into one transistor in the gate driver, thereby reducing the bezel area.

According to the present disclosure, the threshold voltage of the transistor constituting the discharge controller can be adjusted and the leakage current of the transistor can be prevented by applying a negative back-bias to the transistor of the discharge controller for discharging the second control node or by controlling the threshold voltage of the transistor to be a negative voltage with a sufficient voltage margin.

According to the present disclosure, the charge controller allows the second control node to be charged in response to a plurality of clocks generated after a clock for pre-charging the first control node and a clock for boosting the first control node, thereby reducing the floating period and stabilizing the voltage of the low level period of the gate pulse.

The effects of the present disclosure are not limited to the above-mentioned effects, and other effects that are not mentioned will be apparently understood by those skilled in the art from the following description and the appended claims.

BRIEF DESCRIPTION OF THE DRAWINGS

The above and other objects, features, and advantages of the present disclosure will become more apparent to those of ordinary skill in the art by describing exemplary embodiments thereof in detail with reference to the attached drawings, in which.

DETAILED DESCRIPTION OF THE EMBODIMENTS

Figure 1:
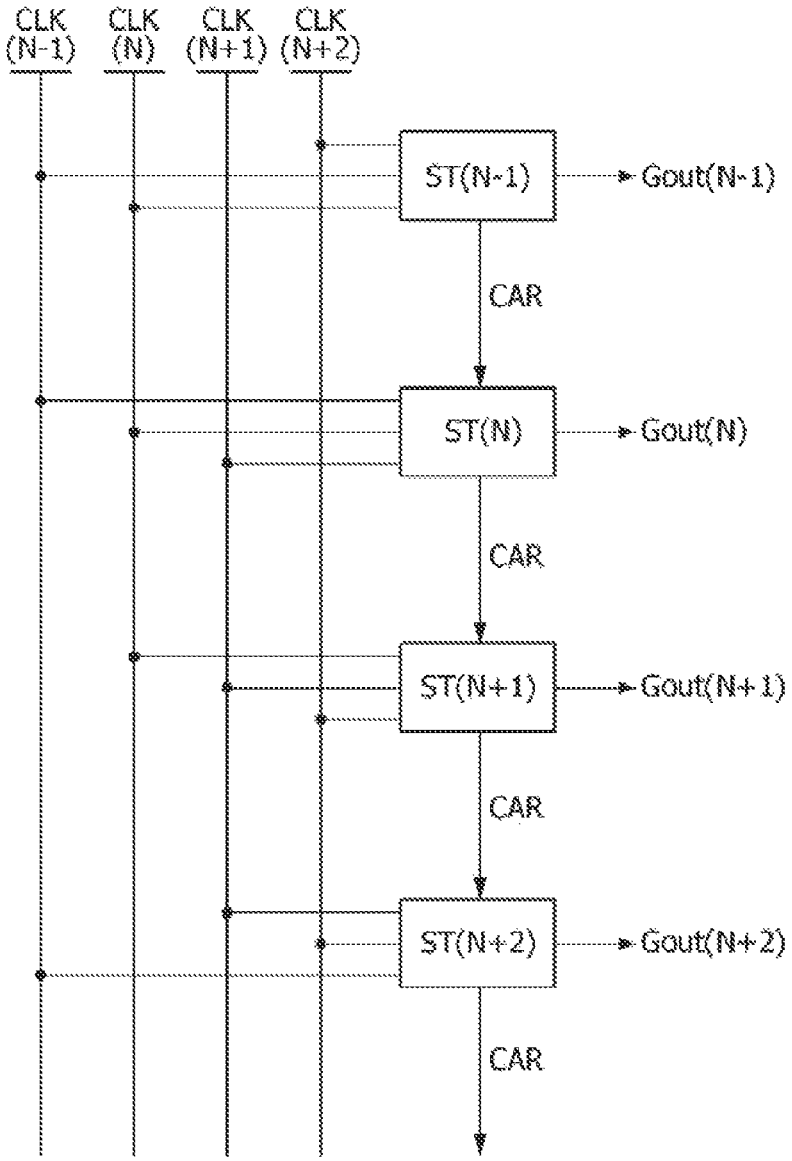
FIG. 1 is a schematic view of a shift register of a gate driving circuit according to an embodiment of the present disclosure.

The advantages and features of the present disclosure and methods for accomplishing the same will be more clearly understood from embodiments described below with reference to the accompanying drawings. However, the present disclosure is not limited to the following embodiments but can be implemented in various different forms. Rather, the present embodiments will make the disclosure of the present disclosure complete and allow those skilled in the art to completely comprehend the scope of the present disclosure. The present disclosure is only defined within the scope of the accompanying claims.

The shapes, sizes, ratios, angles, numbers, and the like illustrated in the accompanying drawings for describing the embodiments of the present disclosure are merely examples, and the present disclosure is not limited thereto. Like reference numerals generally denote like elements throughout the present specification. Further, in describing the present disclosure, detailed descriptions of known related technologies can be omitted to avoid unnecessarily obscuring the subject matter of the present disclosure.

The terms such as "comprising," "including," "having," and "consist of" used herein are generally intended to allow other components to be added unless the terms are used with the term "only." Any references to singular can include plural unless expressly stated otherwise.

Components are interpreted to include an ordinary error range even if not expressly stated.

When the position relation between two components is described using the terms such as "on," "above," "below," and "next," one or more components can be positioned between the two components unless the terms are used with the term "immediately" or "directly."

The terms "first," "second," and the like may not define order, and can be used to distinguish components from each other, but the functions or structures of the components are not limited by ordinal numbers or component names in front of the components.

The following embodiments can be partially or entirely bonded to or combined with each other and can be linked and operated in technically various ways. The embodiments can be carried out independently of or in association with each other.

Each of the pixels can include a plurality of sub-pixels having different colors to in order to reproduce the color of the image on a screen of the display panel. Each of the sub-pixels includes a transistor used as a switch element or a driving element. Such a transistor can be implemented as a TFT (Thin Film Transistor).

A driving circuit of the display device writes a pixel data of an input image to pixels on the display panel. To this end, the driving circuit of the display device can include a data driving circuit configured to supply data signal to the data lines, a gate driving circuit configured to supply a gate signal to the gate lines, and the like.

In a display device of the present disclosure, the pixel circuit and the gate driving circuit can include a plurality of transistors. Transistors can be implemented as oxide thin film transistors (oxide TFTs) including an oxide semiconductor, low temperature polysilicon (LTPS) TFTs including low temperature polysilicon, or the like. In embodiments, descriptions will be given based on an example in which the transistors of the gate driving circuit are implemented as the n-channel oxide TFTs, but the present disclosure is not limited thereto.

A transistor is a three-electrode element including a gate, a source, and a drain. The source is an electrode that supplies carriers to the transistor. In the transistor, carriers start to flow from the source. The drain is an electrode through which carriers exit from the transistor. In a transistor, carriers flow from a source to a drain. In the case of an n-channel transistor, since carriers are electrons, a source voltage is a voltage lower than a drain voltage such that electrons can flow from a source to a drain. The n-channel transistor has a direction of a current flowing from the drain to the source. In the case of a p-channel transistor (p-channel metal-oxide semiconductor (PMOS), since carriers are holes, a source voltage is higher than a drain voltage such that holes can flow from a source to a drain. In the p-channel transistor, since holes flow from the source to the drain, a current flows from the source to the drain. It should be noted that a source and a drain of a transistor are not fixed. For example, a source and a drain can be changed according to an applied voltage. Therefore, the disclosure is not limited due to a source and a drain of a transistor. In the following description, a source and a drain of a transistor will be referred to as a first electrode and a second electrode.

Agate signal swings between a gate-on voltage and a gate-off voltage. The gate-on voltage is set to a voltage higher than a threshold voltage of a transistor, and the gate-off voltage is set to a voltage lower than the threshold voltage of the transistor.

The transistor is turned on in response to the gate-on voltage and is turned off in response to the gate-off voltage. In the case of an n-channel transistor, a gate-on voltage can be a gate high voltage, and a gate-off voltage can be a gate low voltage.

Hereinafter, various embodiments of the present disclosure will be described in detail with reference to the accompanying drawings. In the following embodiments, a display device will be described focusing on an organic light emitting display device, but the present disclosure is not limited thereto. All the components of each display device according to all embodiments of the present disclosure are operatively coupled and configured.

FIG. 1 is a schematic view of a shift register of a gate driving circuit according to an embodiment of the present disclosure.

Referring to FIG. 1, the gate driving circuit of the present disclosure includes a shift register that sequentially outputs pulses [Gout(n−1) to Gout(n+2)] of a gate signal (hereinafter referred to as "gate pulses") in synchronization with shift clocks [CLK(N−1) to CLK(N+2)]. Here, 'N' is a positive integer.

The shift register includes signal transmitters [ST(N−1) to ST(N+2)] connected in a cascade structure and generates sequentially output signals, for example, gate pulses [Gout (N−1) to Gout(N+2)]. Each of the signal transmitters [ST (N−1) to ST(N+2)] includes a VST node to which a start signal VST or a carry signal CAR from a preceding signal transmitter is inputted, a CLK node to which shift clocks [CLK(N−1) to CLK(N+2)] are inputted, a VDD node to which a high-potential driving voltage VGH is applied, a VSS node to which low-potential reference voltages VGL and VGL2 are applied, and a first and second nodes for driving buffer transistors.

The start signal VST is inputted to a first signal transmitter. The shift clocks [CLK(N−1) to CLK(N+2)] can be 4-phase clocks, but are not limited thereto.

The signal transmitters [ST(N) to ST(N+2)], which are dependently connected to the (N−1)th signal transmitter [ST(N−1)], start to be driven by receiving a carry signal CAR as a start signal from their respective preceding signal transmitters. Each of the signal transmitters [ST(N−1) to ST(N+2)] can output gate pulses [Gout(N−1) to Gout(N+2)] through a first output node and can simultaneously output the carry signal CAR through a second output node.

Figure 2:
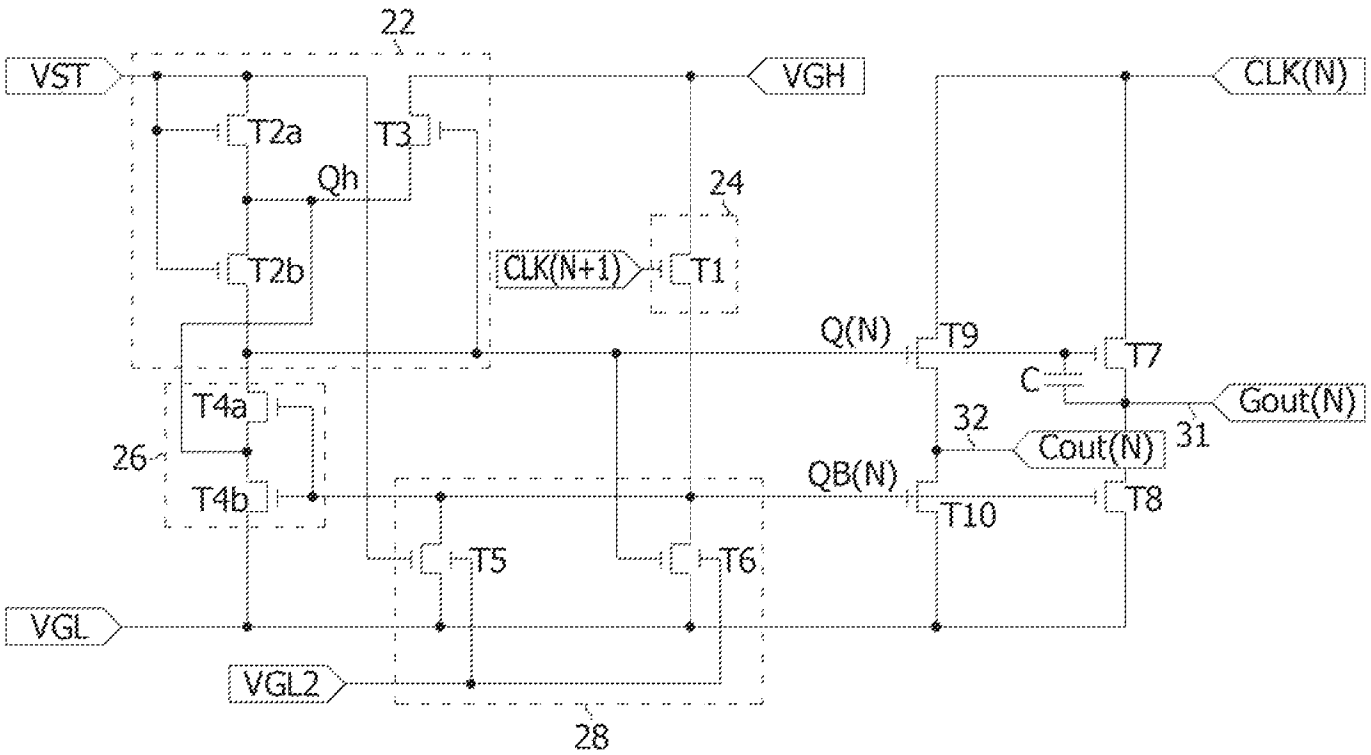
FIG. 2 is a circuit diagram illustrating in detail an Nth signal transmitter according to a first embodiment of the present disclosure.
Figure 3:
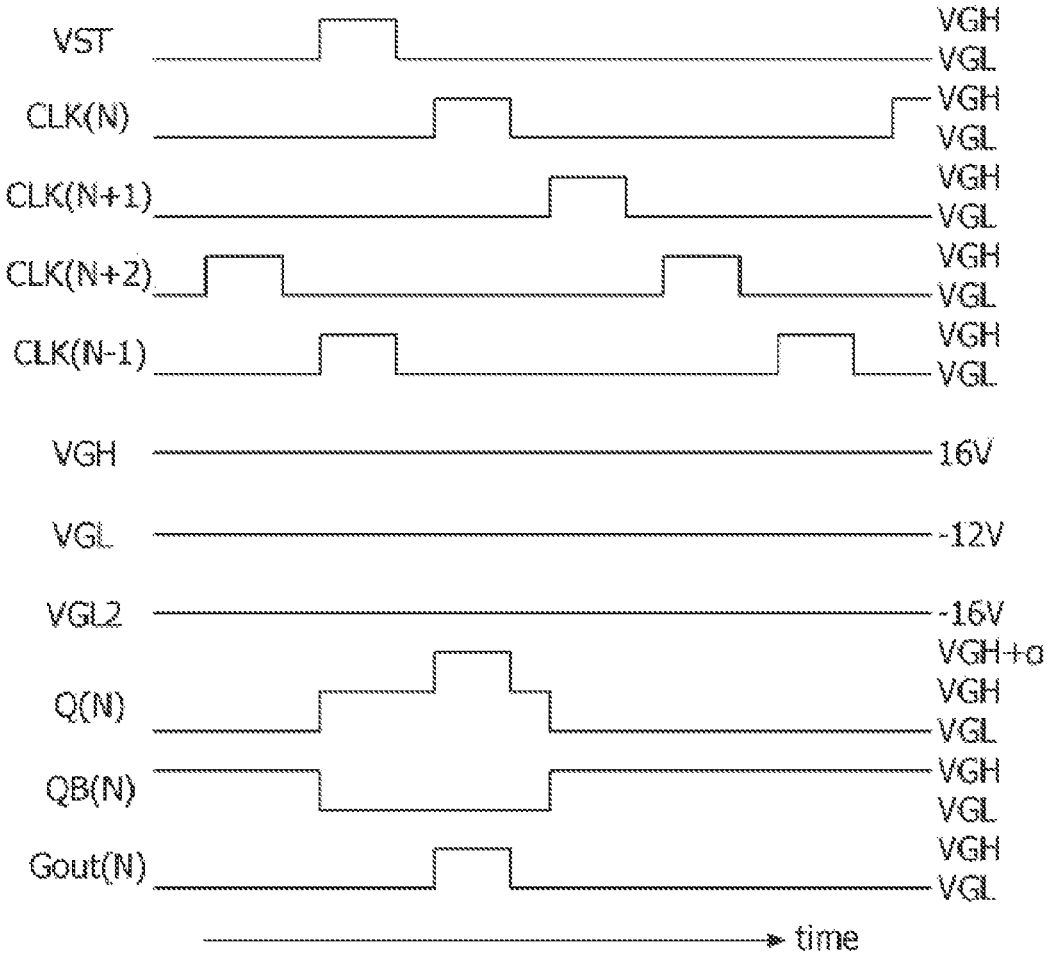
FIG. 3 is a waveform diagram illustrating a start pulse, a shift clock, and a constant voltage to be inputted to signal transmitters.
Figure 4:
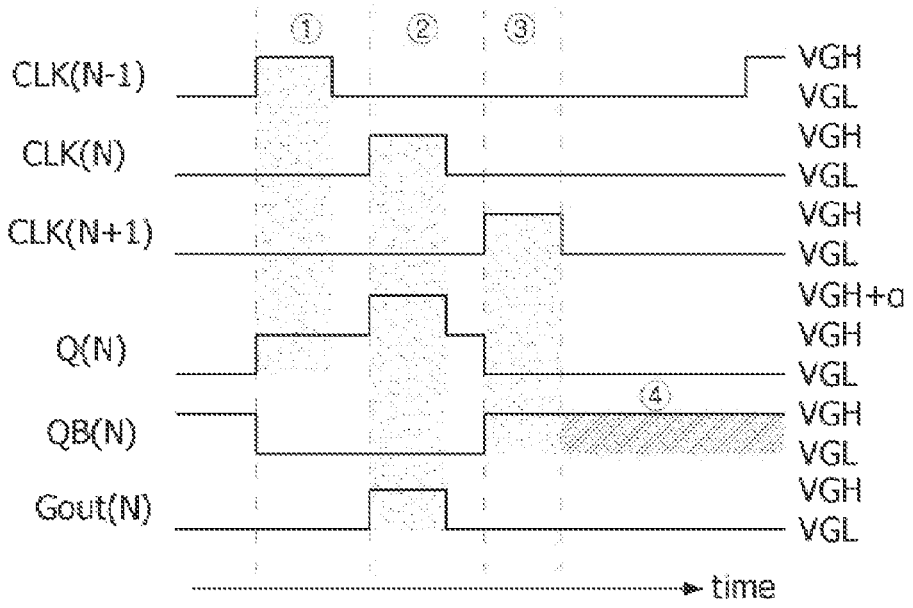
FIG. 4 is a waveform diagram illustrating voltages of control nodes and output nodes of the Nth signal transmitter shown in FIG. 2.

FIG. 2 is a circuit diagram illustrating in detail an Nth signal transmitter [ST(N)] according to a first embodiment of the present disclosure. Signal transmitters other than the Nth signal transmitter [ST(N)] can be embodied as circuits substantially the same as the Nth signal transmitter [ST(N)]. FIG. 3 is a waveform diagram illustrating a start pulse VST, shift clocks [CLK(N−1) to CLK(N+2)], and DC power (or constant voltages) VGH, VGL, and VGL2, which are inputted to the signal transmitters [ST(N−1) to ST(N+2)]. FIG. 4 is a waveform diagram illustrating voltages of control nodes and output nodes of the Nth signal transmitter ST(N) shown in FIG. 2.

Referring to FIGS. 2 to 4, the Nth signal transmitter [ST(N)] includes a first control node [Q(N)], a second control node [QB(N)], a first charge controller 22 for charging the first control node [Q(N)], a second charge controller 24 for charging the second control node [QB(N)], a first discharge controller 26 for discharging the first control node [Q(N)], a second discharge controller 28 for discharging the second control node [QB(N)], and buffer transistors T7, T8, T9, and T10. All of the transistors T1 to T10 constituting the Nth signal transmitter [ST(N)] can be implemented as n-channel oxide TFTs having a coplanar structure.

The Nth signal transmitter [ST(N)] includes a VST node to which a start signal VST or a carry signal CAR from a preceding signal transmitter is inputted, a VDD node to which a high-potential driving voltage VGH is applied, a first VSS node to which a first low-potential reference voltage VGL is applied, a second VSS node to which a second low-potential reference voltage VGL2 is applied, a first CLK node to which an Nth [CLK(N)] is inputted, and a second CLK node to which an (N+1)th clock [CLK(N+1)] is inputted. In another embodiment, the Nth signal transmitter [ST(N)] further includes a third CLK node to which an (N+2)th clock [CLK(N+2)] is applied.

The start pulse VST or the carry signal CAR from the preceding signal transmitter, which is applied to the VST node, is at an AC voltage that swings between the gate driving voltage VGH and the low-potential reference voltage VGL. Similarly, the Nth and (N+1)th clocks [CLK(N) and CLK(N+1)] are at AC voltages that swing between the gate driving voltage VGH and the low-potential reference voltage VGL. As shown in FIG. 3, the gate driving voltage VGH applied to the VST node and the CLK nodes can be 16V, and the low-potential reference voltage VGL applied to the VST node and the CLK nodes can be −12V, but are not limited thereto.

The high-potential driving voltage VGH can be a DC voltage higher than the low-potential reference voltages VGL and VGL2, for example, 16V, but is not limited thereto. The first low-potential reference voltage VGL can be a DC voltage of −12V. In this case, the second low-potential reference voltage VGL2 can be a DC voltage lower than the first low-potential reference voltage VGL, for example, −16V, but is not limited thereto.

The Nth signal transmitter [ST(N)] generates a gate pulse [Vgout(N)] through a first output node 31 and generates a pulse of the carry signal [Cout(N)] through a second output node 32.

The buffer transistors T7, T8, T9, and T10 include one or more pull-up transistors T7 and T9 driven according to the voltage of the first control node [Q(N)], and one or more pull-down transistors T8 and T10 driven according to a voltage of the second control node [QB(N)].

A first pull-up transistor T7 is driven according to the voltage of the first control node [Q(N)] to charge the first output node 31. A first pull-down transistor T8 is driven according to the voltage of the second control node [QB(N)] to discharge the first output node 31. The first pull-up transistor T7 and the first pull-down transistor T8 generate a gate pulse [Vgout(N)] swinging between the high-potential driving voltage VGH and the low-potential reference voltage VGL through the first output node 31.

A second pull-up transistor T9 is driven according to the voltage of the first control node [Q(N)] to charge the second output node 32. A second pull-down transistor T10 is driven according to the voltage of the second control node [QB(N)] to discharge the second output node 32. The second pull-up transistor T9 and the second pull-down transistor T10 generate a pulse of the carry signal [Cout(N)] swinging between the high-potential driving voltage VGH and the low-potential reference voltage VGL through the second output node 32.

The first pull-up transistor T7 includes a gate electrode connected to the first control node [Q(N)], a first electrode connected to a first CLK node to which the Nth clock [CLK(N)] is inputted, and a second electrode connected to the first output node 31. The second pull-up transistor T9 includes a gate electrode connected to the first control node [Q(N)], a first electrode connected to the first CLK node, and a second electrode connected to the second output node 32.

The first pull-down transistor T8 includes a gate electrode connected to the second control node [QB(N)], a first electrode connected to the first output node 31, and a second electrode connected to the first VSS node to which the low-potential reference voltage VGL is applied. The second pull-down transistor T10 includes a gate electrode connected to the second control node [QB(N)], a first electrode connected to the second output node 32, and a second electrode connected to the first VSS node to which the low-potential reference voltage VGL is applied.

The first charge controller 22 pre-charges the first control node to the voltage of the VST node in response to the gate driving voltage VGH of the VST node (see ① of FIG. 4). In a state in which the first control node [Q(N)] has been pre-charged to the gate driving voltage VGH, when the gate driving voltage VGH of the Nth clock [CLK(N)] is applied to the pull-up transistors T7 and T9, bootstrapping occurs through a capacitor C (see ② in FIG. 4), resulting in that the voltage of the first control node Q(N) is boosted and further increases (VGH+α). When the voltage of the first control node [Q(N)] is boosted to VGH+α, the pull-up transistors T7 and T9 are turned on and output the gate pulse [Gout(N)] from the first output node 31 and simultaneously output the pulse [Cout(N)] of the carry signal from the second output node 32.

The second charge controller 24 charges the second control node [QB(N)] to the high-potential driving voltage VGH in response to the gate driving voltage VGH of the second CLK node to which the (N+1)th clock [CLK(N+1)] generated following the Nth clock [CLK(N)] is applied (see ③ of FIG. 4). In this case, the pull-down transistors T8 and T10 are turned on according to the gate driving voltage VGH of the second control node [QB(N)]. Accordingly, as shown in ③ of FIG. 4, the voltages of the output nodes 31 and 32 are discharged up to the first low-potential reference voltage VGL.

When the voltage of the second CLK node is inverted to the first low-potential reference voltage VGL, the second charge controller 24 is turned off. In this case, the second control node [QB(N)] is floated since the charging/discharging paths from the controllers 22, 24, 26, and 28 are blocked (see ④ in FIG. 4).

The first discharge controller 26 discharges the first control node [Q(N)] up to the first low-potential reference voltage VGL in a charging period in which the second control node [QB(N)] is charged to the gate driving voltage VGH. In this case, the voltage of the first control node [Q(N)] is decreased to the first low-potential reference voltage VGL, so that the pull-up transistors T7 and T9 are turned off.

When the voltage of the VST node is the gate driving voltage VGH or the voltage of the first control node [Q(N)] is the gate driving voltage VGH, the second discharge controller 28 discharges the second control node [QB(N)] up to the first low-potential reference voltage VGL. In this case, the voltage of the second control node [QB(N)] is decreased to the first low-potential reference voltage VGL, so that the pull-down transistors T8 and T10 are turned off.

The first charge controller 22 includes at least a second-first transistor T2*a*, a second-second transistor T2*b*, and a third transistor T3. The second-first transistor T2*a* is turned on in response to the gate driving voltage VGH of the VST node to which the start pulse VST or the carry signal from a preceding signal transmitter is applied and connects the VST node to the buffer node Qh. The second-second transistor T2*b* is turned on in response to the gate driving voltage VGH of the VST node and connects the first control node Q(N) to the buffer node Qh. The second-first and second-second transistors T2*a* and T2*b* are turned off when the voltage of the VST node is the first low-potential reference voltage VGL.

The second-first transistor T2*a* includes a gate electrode and a first electrode commonly connected to the VST node, and a second electrode connected to the buffer node Qh. The second-second transistor T2*b* includes a gate electrode connected to the VST node, a first electrode connected to the buffer node Qh, and a second electrode connected to the first control node Q(N). The second-first transistor T2*a* and the second-second transistor T2*b* are connected in series, and a butter node Qh to be charged to the high-potential driving voltage VGH is connected to a node between them. Therefore, leakage currents in the second-first transistor T2*a* and the second-second transistor T2*b* can be reduced or minimized.

The third transistor T3 is turned on in response to the gate driving voltage VGH of the first control node [Q(N)] and connects the VDD node to which the high-potential driving voltage VGH is applied to the buffer node Qh for charging the buffer node Qh. The third transistor T3 is turned off when the voltage of the first control node [Q(N)] is the first low-potential reference voltage VGL. The third transistor T3 includes a gate electrode connected to the first control node [Q(N)], a first electrode connected to the VDD node, and a second electrode connected to the buffer node Qh.

The second charge controller 24 includes a first transistor T1. The first transistor T1 is turned on in response to the gate driving voltage VGH of the (N+1)th clock [CLK(N+1)] and supplies the high-potential driving voltage VGH to the second control node [QB(N)], thereby charging the second control node [QB(N)] and simultaneously driving the first discharge controller 26 to discharge the first control node [Q(N)] (see ③ of FIG. 4). The first transistor T1 is turned off when the voltage of the (N+1)th clock [CLK(N+1)] is at the first low-potential reference voltage VGL. In this case, the second control node [QB(N)] can be floated (see ④ of FIG. 4).

The first transistor T1 includes a gate electrode connected to a second CLK node to which the (N+1)th clock [CLK (N+1)] is applied, a first electrode connected to the VDD node to which the high-potential driving voltage VGH is applied, and a second electrode connected to the second control node [QB(N)].

The first discharge controller 26 includes at least a fourth-first transistor T4*a* and a fourth-second transistor T4*b*. The fourth-first transistor T4*a* is turned on in response to the gate driving voltage VGH of the second control node [QB(N)] and connects the first control node [Q(N)] to the buffer node Qh. The fourth-second transistor T4*b* is turned on in response to the gate driving voltage VGH of the second control node [QB(N)] and connects the buffer node Qh to the first VSS node to which the first low-potential reference voltage VGL is applied. Accordingly, when the voltage of the second control node [QB(N)] is the gate driving voltage VGH by means of the second charge controller 24 (see ③ of FIG. 4), the fourth-first and fourth-second transistors T4*a* and T4*b* connect the first control node [Q(N)] to the first VSS node so that the first control node [Q(N)] is discharged up to the first low-potential reference voltage VGL. The fourth-first and fourth-second transistors T4*a* and T4*b* are turned off when the voltage of the second control node [QB(N)] is the first low-potential reference voltage VGL (see ① and ② of FIG. 4).

The fourth-first transistor T4*a* includes a gate electrode connected to the second control node [QB(N)], a first electrode connected to the first control node [Q(N)], and a second electrode connected to the buffer node Qh. The fourth-second transistor T4*b* includes a gate electrode connected to the second control node [QB(N)], a first electrode connected to the buffer node Qh, and a second electrode connected to the first VSS node to which the low-potential reference voltage VGL is applied. The fourth-first transistor T4*a* and the fourth-second transistor T4*b* are connected in series, and a butter node Qh to be charged to the high-potential driving voltage VGH is connected to a node between them. Therefore, leakage currents in the fourth-first transistor T4*a* and the fourth-second transistor T4*b* can be reduced or minimized.

The second discharge controller 28 includes at least a fifth transistor T5 and a sixth transistor T6. The fifth transistor T5 is turned on when the voltage of the VST node to which the start pulse VST or the carry signal from a preceding signal transmitter is applied is the gate driving voltage VGH and discharges the second control node [QB(N)] up to the first low-potential reference voltage VGL. When the voltage of the first control node [Q(N)] is the gate driving voltage VGH, the sixth transistor T6 is turned on and discharges the second control node [QB(N)] up to the first low-potential reference voltage VGL. The fifth transistor T5 is turned off when the voltage of the VST node is the first low-potential reference voltage VGL, and the sixth transistor T6 is turned off when the voltage of the first control node [Q(N)] is the low-potential reference voltage VGL.

The transistors constituting the gate driving circuit can be implemented as n-channel oxide TFTs having a coplanar structure. An n-channel oxide TFT having the coplanar structure has a large on-current (Ion) and a high slope of the S-factor because the thickness of the gate insulating film is thinner than that of a back channel etch (BCE) structure. As a result, when the fifth and sixth transistors T5 and T6 are implemented as an n-channel oxide TFT having a coplanar structure, leakage currents can occur when the gate-source voltage Vgs is 'Vgs=0' in a case where the initial threshold voltage Vth is 'Vth<0'.

Figure 5:
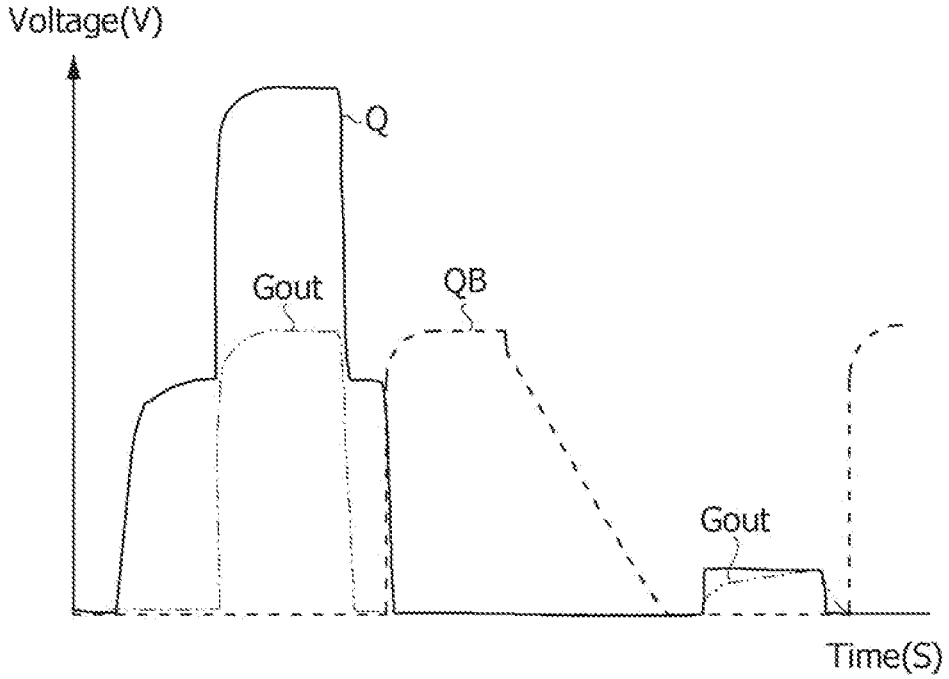
FIG. 5 is a waveform diagram illustrating a ripple of a VGL holding period of a gate pulse generated due to an unwanted discharge in a second control node in a case where transistors constituting the second discharge controller are implemented as transistors having a single gate.

In a case where the second charge controller 24 is implemented as one transistor T1 and the transistors T1 to T10 are implemented as an n-channel oxide TFT having a coplanar structure, the second control node [QB(N)] is discharged due to leakage currents which can occur when the threshold voltages Vth of the fifth and sixth transistors T5 and T6 are negatively shifted. As a result, as shown in FIG. 5, a clock ripple can be generated in the VGL holding period of the gate pulse [Gout(N)].

As shown in FIG. 2, the present disclosure can form the fifth and sixth transistors T5 and T6 as TFTs having a coplanar structure with a double gate, thereby shifting the threshold voltages Vth of the fifth and sixth transistors T5 and T6 to a voltage higher than 0. Accordingly, the discharge of the second control node [QB(N)] can be suppressed during the VGH holding period of the second control node [QB(N)] by preventing the threshold voltages Vth of the fifth and sixth transistors T5 and T6 from being negatively shifted. The VGH holding period of the second control node [QB(N)] is the same as the VGL holding period of the gate pulse [Gout(N)].

The fifth transistor T5 includes a first gate electrode connected to the VST node to which the start pulse VST or the carrier signal from the preceding signal transmitter is applied, a second gate electrode connected to the second VSS node to which the second low-potential reference voltage VGL2 is applied, a first electrode connected to the second control node [QB(N)], and a second electrode connected to the first VSS node to which the first low-potential reference voltage is applied. Since the second low-potential reference voltage VGL2 is a voltage lower than the first low-potential reference voltage VGL, a negative back-bias is applied between the second gate electrode and the second electrode of the fifth transistor T5 and the threshold voltage Vth of the fifth transistor T5 is positively shifted to a voltage higher than 0V, thereby reducing or minimizing the leakage current of the fifth transistor T5.

The sixth transistor T6 includes a first gate electrode connected to the first control node [Q(N)], a second gate electrode connected to the second VSS node to which the second low-potential reference voltage VGL2 is applied, a first electrode connected to the second control node [QB (N)], and a second electrode connected to the first VSS node to which the first low-potential reference voltage is applied. Since the second low-potential reference voltage VGL2 is a voltage lower than the first low-potential reference voltage VGL, a negative back-bias is applied between the second gate electrode and the second electrode of the sixth transistor T6 and the threshold voltage Vth of the sixth transistor T6 is positively shifted to a voltage higher than 0V, thereby reducing or minimizing the leakage current of the sixth transistor T6.

Figure 6:
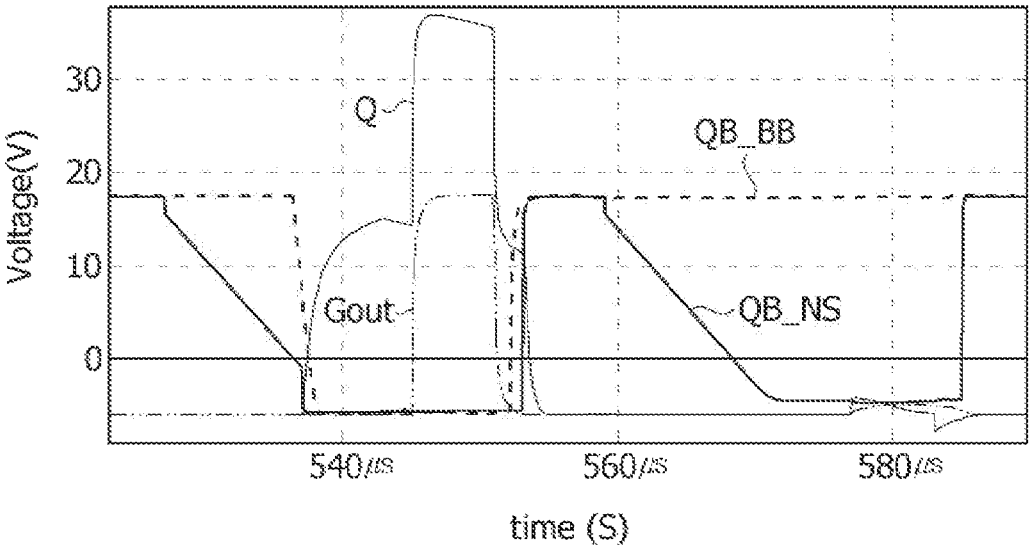
FIG. 6 is a simulation result illustrating the discharge suppression effect on a voltage of a second control node when a negative back-bias is applied to the fifth and sixth transistors shown in FIG. 2.

FIG. 6 illustrates a simulation result comparing a case where a negative back-bias is applied to the fifth and sixth transistors T5 and T6 and a case where the negative back-bias is not applied to the fifth and sixth transistors T5 and T6.

In FIG. 6, "QB_BB" denotes the voltage of the second control node [QB(N)] when the fifth and sixth transistors T5 and T6 are implemented by a double gate structure and a negative back-bias is applied thereto. 'QB_NS' denotes the voltage of the second control node [QB(N)] when the fifth and sixth transistors T5 and T6 are implemented by a single gate structure and no negative back-bias is applied thereto. In FIG. 6, 'Q' denotes the voltage of the first control node [Q(N)], and 'Gout' denotes the voltage of the gate pulse. As can be seen from FIG. 6, when a negative back-bias is applied to the fifth and sixth transistors T5 and T6, the threshold voltage is positively shifted, which results in that the second control node [QB(N)] does not discharged in the VGH holding period of the second control node [QB(N)].

Figure 7:
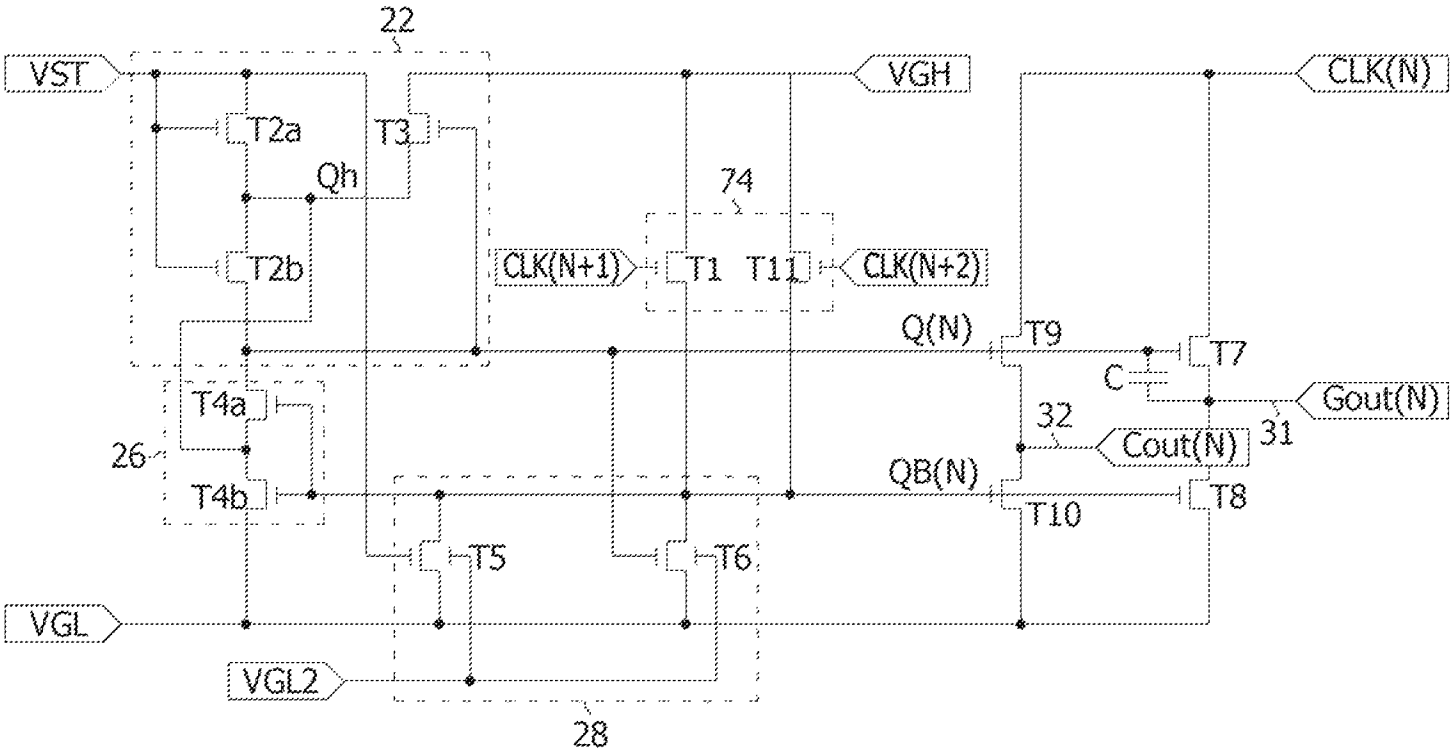
FIG. 7 is a circuit diagram illustrating in detail an Nth signal transmitter according to a second embodiment of the present disclosure.
Figure 8:
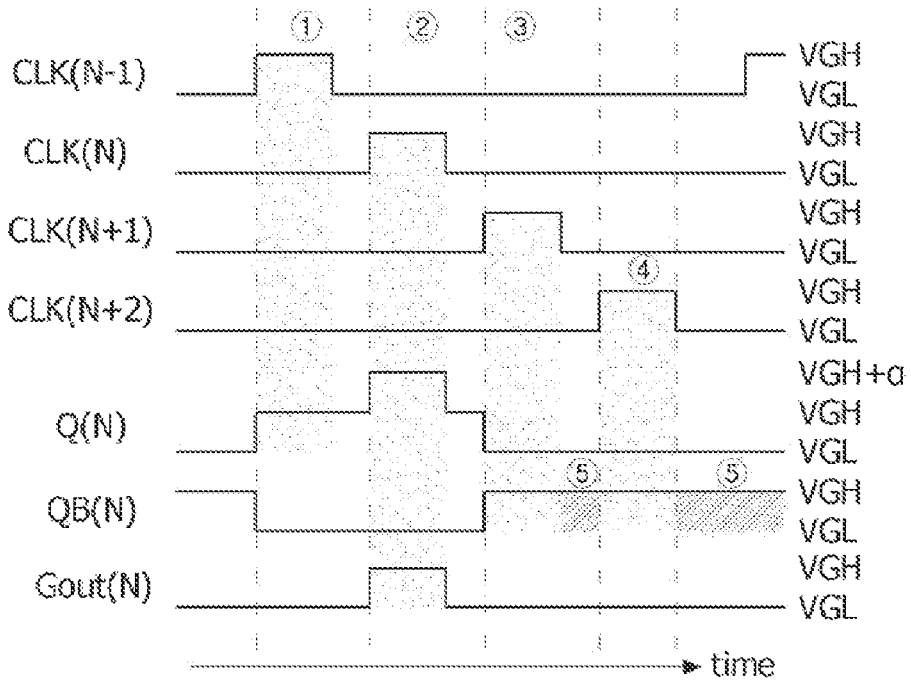
FIG. 8 is a waveform diagram illustrating voltages of control nodes and output nodes of the Nth signal transmitter shown in FIG. 7.

FIG. 7 is a circuit diagram illustrating in detail an Nth signal transmitter [ST(N)] according to a second embodiment of the present disclosure. Signal transmitters other than the Nth signal transmitter [ST(N)] can be embodied as circuits substantially the same as the Nth signal transmitter [ST(N)]. In FIG. 7, components substantially the same as those in the first embodiment are given the same reference numerals, and detailed description thereof will be omitted. FIG. 8 is a waveform diagram illustrating voltages of control nodes and output nodes of the Nth signal transmitter [ST(N)] shown in FIG. 7.

Referring to FIGS. 7 to 8, the Nth signal transmitter [ST(N)] includes a first control node [Q(N)], a second control node [QB(N)], a first charge controller 22 for charging the first control node [Q(N)], a second charge controller 74 for charging the second control node [QB(N)], a first discharge controller 26 for discharging the first control node [Q(N)], a second discharge controller 28 for discharging the second control node [QB(N)], and buffer transistors T7, T8, T9, and T10. All of the transistors T1 to T11 constituting the Nth signal transmitter [ST(N)] can be implemented as n-channel oxide TFTs.

The second charge controller 74 charges the second control node [QB(N)] to the high-potential driving voltage VGH in response to the gate driving voltage VGH of the second CLK node to which the (N+1)th clock [CLK(N+1)] generated following the Nth clock [CLK(N)] is applied and the gate driving voltage VGH of the third CLK node to which the (N+2)th clock [CLK(N+2)] generated following the (N+1)th clock [CLK(N+1)] is applied (see ③ and ④ of FIG. 8). In this case, the pull-down transistors T8 and T10 are turned on according to the gate driving voltage VGH of the second control node [QB(N)]. Accordingly, as shown in ③ and ④ of FIG. 8, the voltages of the output nodes 31 and 32 are discharged up to the first low-potential reference voltage VGL.

When the voltages of the second and third CLK nodes are inverted to the first low-potential reference voltage VGL, the second charge controller 74 is turned off. In this case, the second control node [QB(N)] is floated since the charging/discharging paths from the controllers 22, 74, 26, and 28 is blocked (see ⑤ of FIG. 8).

The second discharge controller 74 includes a first transistor T1 and an eleventh transistor T11. The first transistor T1 is turned on in response to the gate driving voltage VGH of the (N+1)th clock [CLK(N+1)] and supplies the high-potential driving voltage VGH to the second control node [QB(N)], thereby charging the second control node [QB(N)] and simultaneously driving the first discharge controller 26 to discharge the first control node [Q(N)] (see ③ of FIG. 8). The eleventh transistor T11 is turned on in response to the gate driving voltage VGH of the (N+2)th clock [CLK(N+2)] and supplies the high-potential driving voltage VGH to the second control node [QB(N)], thereby charging the second control node [QB(N)] and simultaneously driving the first discharge controller 26 to discharge the first control node [Q(N)] (see ④ of FIG. 8). According to this embodiment, the floating period is reduced in the VGH holding period of the second control node [QB(N)], and thus the voltage of a gate line to which the gate pulse [Gout(N)] is applied can be more stably held in the VGL holding period of the gate pulse [Gout(N)]. In this embodiment, the floating period of the second control node [QB(N)] includes a period between ③ and ④ of FIG. 8 and a period after ④ of FIG. 8, e.g., ⑤ of FIG. 8.

The clock for controlling the eleventh transistor T11 is not limited to the (N+2)th clock [CLK(N+2)]. For example, the (N+2)th clock [CLK(N+2)] can be any clock following the (N+1)th clock [CLK(N+1)], except for a clock for inducing pre-charging and boosting of the first control node [Q(N)]. In the example of FIG. 2, since the four-phase clock is applied from four clock lines in a cyclic manner, the (N+2)th clock [CLK(N+2)] can be replaced with an (N−1)th clock [CLK(N−1)] to be generated after the (N+2)th clock [CLK (N+2)].

The first transistor T1 is turned off when the (N+1)th clock [CLK(N+1)] is at the first low-potential reference voltage VGL, and the second control node QB(N) is floated (see a period between ③ and ④ of FIG. 8). The eleventh transistor T11 is turned off when the (N+2)th clock [CLK (N+2)] is at the first low-potential reference voltage VGL, and the second control node [QB(N)] is floated (see a period after ④ of FIG. 8). The eleventh transistor T11 includes a gate electrode connected to a third CLK node to which an (N+2)th clock [CLK(N+2)] is applied, a first electrode connected to a VDD node to which the high-potential driving voltage VGH is applied, and a second electrode connected to the second control node [QB(N)].

Figure 9:
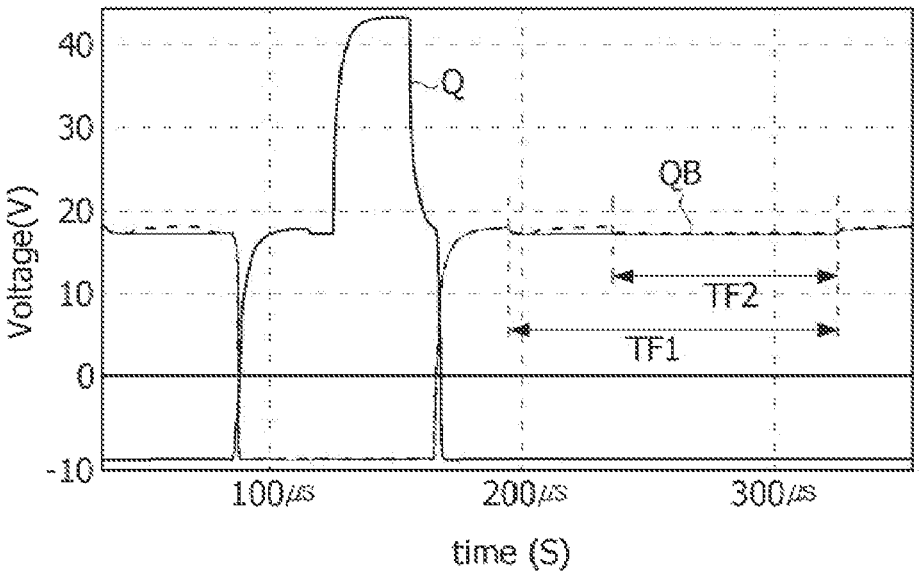
FIG. 9 is a diagram comparing floating periods for the second control nodes in the gate driving circuit shown in FIG. 2 and the gate driving circuit shown in FIG. 7.

The first and eleventh transistors T1 and T11 supply the high-potential driving voltage VGH to the second control node [QB(N)] in the VGH holding period of the second control node [QB(N)] in response to the (N+1)th and (N+2) th clocks [CLK(N+1) and CLK(N+2)]. As a result, as shown in FIGS. 8 and 9, the floating period is reduced in the VGH holding period of the second control node [QB(N)] compared to the first embodiment described above, so that the pull-down transistors T8 and T10 can be driven more stably. A period ⑤ of FIG. 8 is a floating period. In FIG. 9, 'TF1' is a floating period of the second control node [QB(N)] in the gate driving circuit shown in FIG. 2, and 'TF2' is a floating period of the second control node [QB(N)] in the gate driving circuit shown in FIG. 7.

Figure 10:
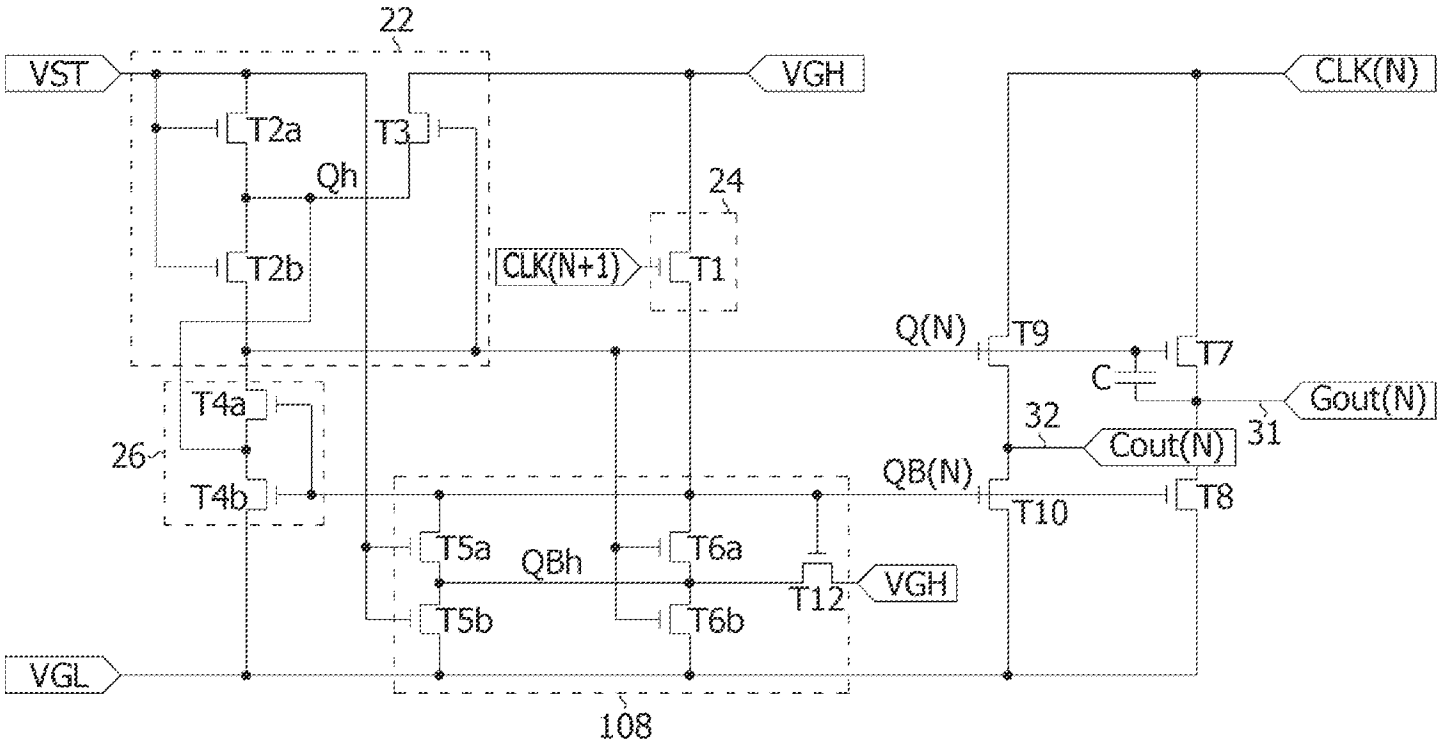
FIG. 10 is a circuit diagram illustrating in detail an Nth signal transmitter according to a third embodiment of the present disclosure.
Figure 11:
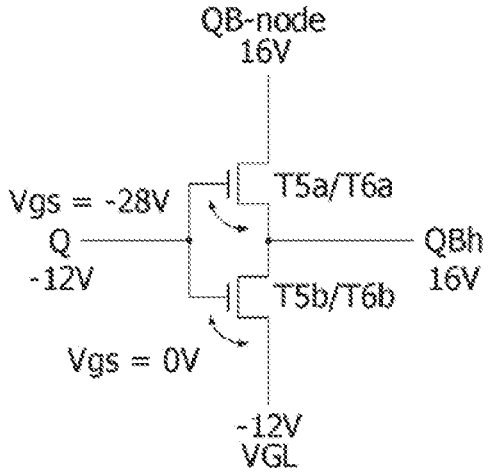
FIG. 11 is a circuit diagram illustrating gate-source voltages of transistors constituting the second discharge controller shown in FIG. 10.
Figure 12:
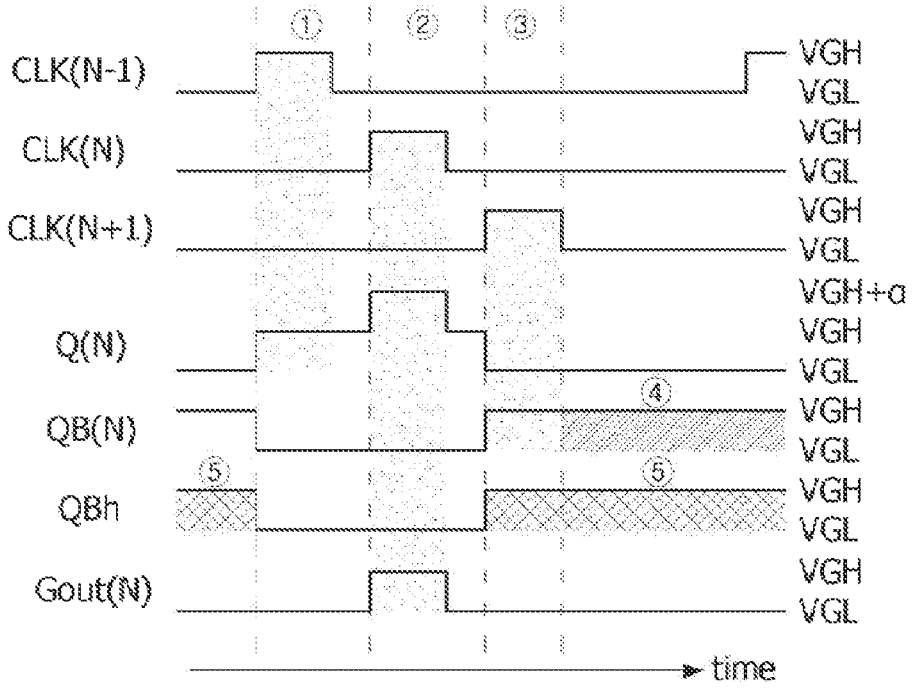
FIG. 12 is a waveform diagram illustrating voltages of control nodes and output nodes of the Nth signal transmitter shown in FIG. 10.

FIG. 10 is a circuit diagram illustrating in detail an Nth signal transmitter according to a third embodiment of the present disclosure. Signal transmitters other than the Nth signal transmitter [ST(N)] can be embodied as circuits substantially the same as the Nth signal transmitter [ST(N)]. In FIG. 10, components substantially the same as those in the first embodiment are given the same reference numerals, and detailed description thereof will be omitted. FIG. 11 is a circuit diagram illustrating gate-source voltages of transistors constituting the second discharge controller shown in FIG. 10. FIG. 12 is a waveform diagram illustrating voltages of control nodes and output nodes of the Nth signal transmitter shown in FIG. 10.

Referring to FIGS. 10 to 12, the Nth signal transmitter [ST(N)] includes a first control node [Q(N)], a second control node [QB(N)], a first charge controller 22 for charging the first control node [Q(N)], a second charge controller 24 for charging the second control node [QB(N)], a first discharge controller 26 for discharging the first control node [Q(N)], a second discharge controller 108 for discharging the second control node [QB(N)], and buffer transistors T7, T8, T9, and T10. All of the transistors T1 to T10 and T12 constituting the Nth signal transmitter [ST(N)] can be implemented as n-channel oxide TFTs.

In FIG. 10, the second charge controller 24 can charge the second control node [QB(N)] by means of the first transistor T1 in response to the (N+1)th clock [CLK(N+1)] generated following the Nth clock [CLK(N)]. The second charge controller 24 can further include the eleventh transistor T11 shown in FIG. 7 to charge the second control node [QB(N)] in response to the (N+2)th clock [CLK(N+2)]. For example, the second charge controller 24 of FIG. 10 can also be implemented as the second charge controller 74 of FIG. 7, but the present disclosure is not limited thereto.

When the voltage of the VST node is the gate driving voltage VGH or the voltage of the first control node [Q(N)] is the gate driving voltage VGH, the second discharge controller 108 discharges the second control node [QB(N)] up to the first low-potential reference voltage VGL. The second discharge controller 108 of this embodiment can prevent a leakage current by expanding the gate-source voltage margin when it is difficult to adapt the transistors to which the back-bias voltage is applied.

The second discharge controller 108 includes at least a fifth-first transistor T5*a*, a fifth-second transistor T5*b*, a sixth-first transistor T6*a*, a sixth-second transistor T6*b*, and a twelfth transistor T12.

The fifth-first and fifth-second transistors T5*a* and T5*b* are turned on when the voltage of the VST node to which the start pulse VST or the carry signal from a preceding signal transmitter is applied is the gate driving voltage VGH and discharge the second control node [QB(N)] up to the first low-potential reference voltage VGL. The sixth-first and sixth-second transistors T6*a* and T6*b* are turned on when the voltage of the first control node [Q(N)] is the gate driving voltage VGH and discharge the second control node [QB (N)] up to the first low-potential reference voltage VGL. The fifth-first and fifth-second transistors T5*a* and T5*b* are turned off when the voltage of the VST node is the low-potential reference voltage VGL, and the sixth-first and sixth-second transistors T6*a* and T6*b* are turned off when the voltage of the first control node [Q(N)] is the low-potential reference voltage VGL.

The twelfth transistor T12 is turned on when the second control node [QB(N)] is charged to the gate driving voltage VGH and supplies the high-potential driving voltage VGH to the second buffer node QBh between the transistors T5*a*, T5*b*, T6*a*, and T6*b* connected in series between the second control node [QB(N)] and the VSS node. When the voltage of the second buffer node QBh is increased to the voltage level of the second control node [QB(N)] charged to the gate driving voltage VGH, the gate-source voltages Vgs of the fifth-first and sixth-first transistors T5*a* and T6*a* can ensure a voltage margin much lower than 0V. Consequently, even if the threshold voltages of the fifth-first and sixth-first transistors T5*a* and T6*a* are negatively shifted to a voltage lower than 0V, the transistors T5*a* and T6*a* can be turned off without a leakage current.

As illustrated in FIG. 11, when the voltage of the second control node [QB(N)] and the second buffer node QBh is a high-potential driving voltage VGH (=16V) and the first control node [Q(N)] is discharged to be a low-potential reference voltage VGL (=−12V), a gate-source voltage Vgs of the fifth-first and sixth-first transistors T5*a* and Ta6 is −28V much lower than 0V. In this case, the gate-source voltage Vgs of the fifth-second and sixth-second transistors T5*b* and T6*b* is 0V.

The fifth-first transistor T5*a* includes a gate electrode connected to the VST node, a first electrode connected to the second control node [QB(N)], and a second electrode connected to the second buffer node QBh. The fifth-second transistor T5*b* includes a gate electrode connected to the VST node, a first electrode connected to the second buffer node QBh, and a second electrode connected to the VSS node to which the low-potential reference voltage VGL is applied.

The sixth-first transistor T6*a* includes a gate electrode connected to the first control node [Q(N)], a first electrode connected to the second control node [QB(N)], and a second electrode connected to the second buffer node QBh. The sixth-second transistor T6*b* includes a gate electrode connected to the first control node [Q(N)], a first electrode connected to the second buffer node QBh, and a second electrode connected to the VSS node to which the low-potential reference voltage VGL is applied.

The twelfth transistor T12 includes a gate electrode connected to the second control node [QB(N)], a first electrode connected to the second buffer node QBh, and a second electrode to which the high-potential driving voltage is applied.

Figure 13:
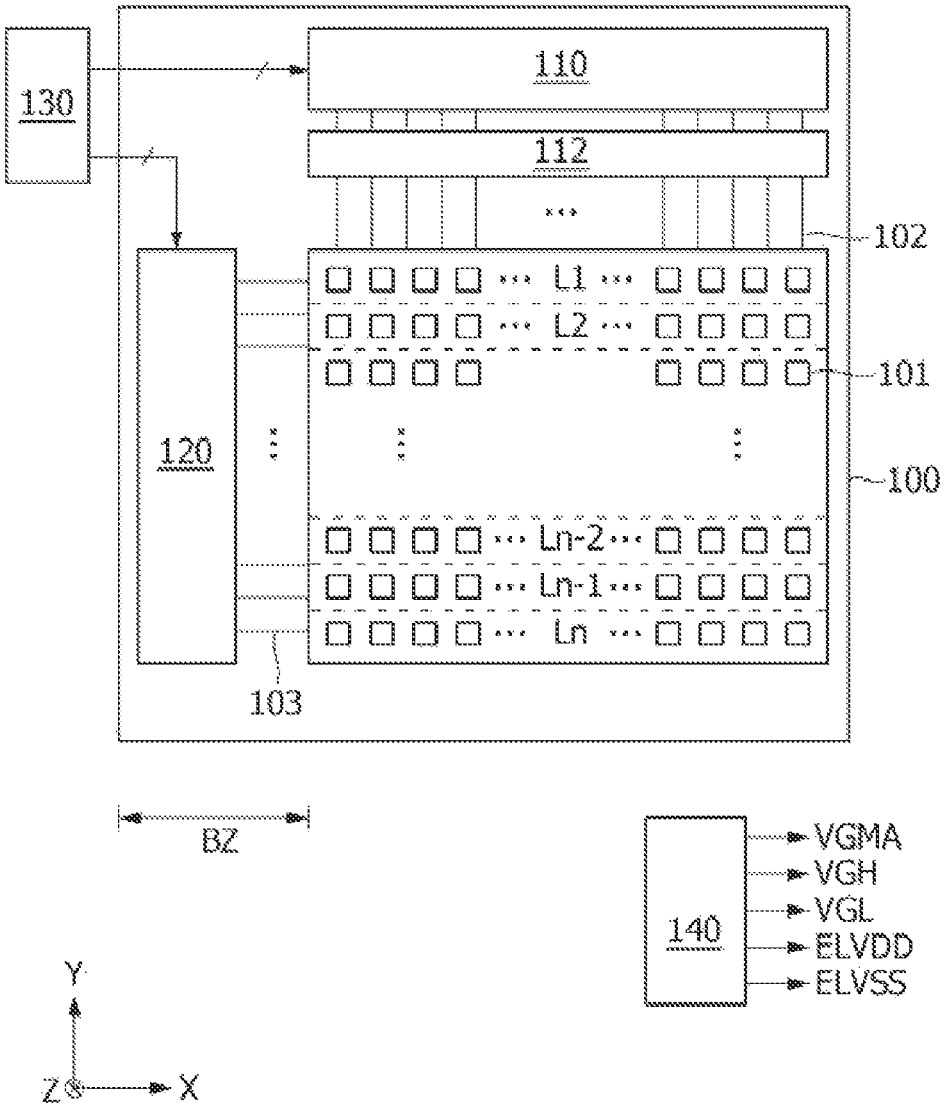
FIG. 13 is a block diagram illustrating a display device according to an embodiment of the present disclosure.
Figure 14:
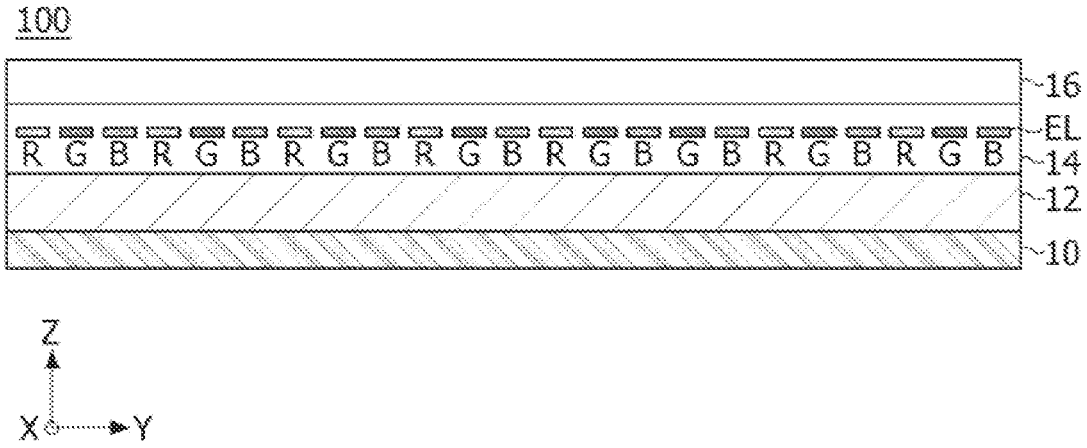
FIG. 14 is a cross-sectional view illustrating a cross-sectional structure of the display panel shown in FIG. 13.

FIG. 13 is a block diagram illustrating a display device according to an embodiment of the present disclosure. FIG. 14 is a cross-sectional view illustrating a cross-sectional structure of the display panel shown in FIG. 13.

Referring to FIGS. 13 and 14, the display device according to an embodiment of the present disclosure includes a display panel 100, a display panel driver for writing pixel data to pixels of the display panel 100, and a power supply 140 for generating power necessary to drive the pixels and the display panel driver.

The display panel 100 can be a panel having a rectangular structure with a length in the X-axis direction, a width in the Y-axis direction, and a thickness in the Z-axis direction. The display panel 100 includes a pixel array that displays an input image on a screen. The pixel array includes a plurality of data lines 102, a plurality of gate lines 103 intersected with the data lines 102, and pixels arranged in a matrix form. The display panel 100 can further include power lines commonly connected to the pixels. The power lines supply a constant voltage necessary for driving the pixels 101 to the pixels 101. For example, the display panel 100 can include a VDD line through which a pixel driving voltage EVDD is applied, and a VSS line through which a low-potential pixel reference voltage EVSS is applied. In addition, the power lines can further include an REF line through which a reference voltage Vref is applied, and an INIT line through which an initialization voltage Vinit is applied.

As shown in FIG. 14, the cross-sectional structure of the display panel 100 can include a circuit layer 12, a light emitting element layer 14, and an encapsulation layer 16 stacked on a substrate 10.

The circuit layer 12 can include a thin-film transistor (TFT) array including a pixel circuit connected to wirings such as a data line, a gate line, a power line, and the like, a de-multiplexer array 112, and a gate driver 120. The wirings and circuit elements in the circuit layer 12 can include a plurality of insulating layers, two or more metal layers separated with the insulating layer therebetween, and an active layer including a semiconductor material. All transistors formed in the circuit layer 12 can be implemented as n-channel oxide TFTs having a coplanar structure.

The light-emitting element layer 14 can include a light-emitting element EL driven by the pixel circuit. The light-emitting elements EL can include a red (R) light-emitting element, a green (G) light-emitting element, and a blue (B) light-emitting element. In another embodiment, the light-emitting element layer 14 can include a white light-emitting element and a color filter. The light-emitting elements EL in the light-emitting element layer 14 can be covered by a protective layer including an organic film and a passivation film.

The light-emitting element EL can be implemented as an OLED. The OLED includes an organic compound layer formed between an anode electrode and a cathode electrode. The organic compound layer can include, but is not limited to, a hole injection layer (HIL), a hole transport layer (HTL), an emission layer (EML), an electron transport layer (ETL), and an electron injection layer (EIL). When a voltage is applied to the anode and cathode electrodes of the OLED, the holes that have passed through the hole transport layer HTL and the electrons that have passed through the electron transport layer ETL are moved to the emission layer EML, and excitons are formed. In this case, visible light is emitted from the emission layer (EML). The OLED used as the light-emitting element EL can be of a tandem structure in which a plurality of light-emitting layers are stacked. An OLED having the tandem structure can improve the luminance and lifespan of pixels.

The encapsulation layer 16 covers the light-emitting element layer 14 to seal the circuit layer 12 and the light-emitting element layer 14. The encapsulation layer 16 can be a multi-insulating film structure in which an organic film and an inorganic film are alternately stacked. The inorganic film blocks infiltration of moisture or oxygen. The organic film planarizes a surface of the inorganic film. When the organic film and the inorganic film are stacked in multiple layers, a moving path of moisture or oxygen is longer than that of a single layer and thus the infiltration of moisture and oxygen that can influence the light-emitting element layer 14 can be effectively blocked.

A touch sensor layer can be formed on the encapsulation layer 16 and a polarizing plate or a color filter layer can be disposed on the touch sensor layer. The touch sensor layer can include capacitance touch sensors that sense a touch input on the basis of a change in capacitance before and after the touch input is input. The touch sensor layer can include metal interconnection patterns and insulating films that form a capacity of the touch sensors. The insulating films can insulate intersections of the metal interconnection patterns and planarize a surface of the touch sensor layer. The polarizing plate can convert polarization of external light reflected from the metals of the touch sensor layer and the circuit layer to improve visibility and a contrast ratio. The polarizing plate can be embodied as a linear polarizing plate or circular polarizing plate in which a linear polarizing plate and a phase-delay film are bonded with each other. Cover glass can be adhered on the polarizing plate. The color filter layer can include red, green, and blue color filters. The color filter layer can further include a black matrix pattern. The color filter layer can absorb some light reflected from the circuit layer and the touch sensor layer instead of the polarizing plate and increase the color purity of an image reproduced on the pixel array.

The pixel array includes a plurality of pixel lines L1 to Ln. Each of the pixel lines L1 to Ln includes pixels in a pixel line that are arranged on the pixel array of the display panel 100 in a direction of lines (X-axis direction). Pixels arranged in a first pixel line share the gate lines 103. Subpixels arranged in a column direction Y along a data-line direction share the same data line 102. 1 horizontal period is a time obtained by dividing a first frame period by the total number of the pixel lines L1 to Ln.

The display panel 100 can be embodied as a non-transmissive display panel or a transmissive display panel. The transmissive display panel is applicable to a transparent display device in which an image is displayed on a screen and through which a real background is visible. The display panel 100 can be manufactured as a flexible display panel.

Each pixel 101 can be divided into a red sub-pixel, a green sub-pixel, and a blue sub-pixel to realize colors. Each of the pixels 101 can further include a white sub-pixel. Each of the sub-pixels includes a pixel circuit. Hereinafter, "pixel" can be understood as having the same meaning as "sub-pixel." Each pixel circuit is connected to a data line, gate lines, and power lines.

The pixel circuit includes a light-emitting element EL, a driving element for driving the light-emitting element, and one or more switch elements. The switch elements are turned on or off according to a gate voltage of a gate pulse to connect or disconnect main nodes of the pixel circuit. The switch elements are turned on in response to the gate-on voltage, whereas it is turned off in response to the gate-off voltage. In a case of the n-channel oxide TFT, the gate-on voltage is a high-potential driving voltage VGH of the gate pulse [Gout(N)] outputted from the gate driver 120, and the gate-off voltage is a low-potential reference voltage VGL of the gate pulse [Gout(N)]. The driving element and the switch elements of the pixel circuit can be implemented as n-channel oxide TFTs having a coplanar structure.

Due to process deviation and element characteristics variations caused in the manufacturing process of the display panel, there can be a difference in electrical characteristics of a driving element between pixels, and this difference can be increased as the driving time of the pixels elapses. In order to compensate for variations in the electrical characteristics of the driving element between the pixels, an internal compensation circuit can be embedded in the pixel circuit or an external compensation circuit can be connected to the pixel circuit. The internal compensation circuit can be embedded in the pixel circuit and sense the amount of the threshold voltage change of the driving element, thereby compensating the gate-source voltage of the driving element by the amount of the threshold voltage change. The external compensation circuit can compensate for the change in the electrical characteristics of the driving element by generating a compensation value based on a result of sensing the electrical characteristics of the driving element using the external compensation circuit connected to the pixel circuit. The pixel circuit of the respective sub-pixels can include the internal compensation circuit or can be connected to the external compensation circuit.

The pixels can be arranged as real color pixels and pentile pixels. A pentile pixel can realize a higher resolution than the real color pixel by driving two sub-pixels having different colors as one pixel 101 through the use of a preset pixel rendering algorithm. The pixel rendering algorithm can compensate for insufficient color representation in each pixel with the color of light emitted from an adjacent pixel.

The power supply 140 generates a DC voltage (or constant voltage) necessary for driving the pixel array of the display panel 100 and the display panel driver by using a DC-DC converter. The DC-DC converter can include a charge pump, a regulator, a buck converter, a boost converter, and the like. The power supply 140 can adjust the level of a DC input voltage applied from a host system to generate constant voltages such as a gamma reference voltage VGMA, the gate voltages VGH, VEH, VGL, and VEL, the pixel driving voltage EVDD, the pixel driving voltage ELVDD, and the low-potential pixel reference voltage ELVSS. The gamma reference voltage VGMA is supplied to the data driver 110. The gate voltages VGH and VGL are supplied to the gate driver 120. The pixel driving voltage ELVDD and the low-potential pixel reference voltage ELVSS are supplied to the pixels 101 through the power lines commonly connected to the pixels 101.

The display panel driver writes pixel data of an input image to the pixels of the display panel 100 under control of a timing controller 130.

The display panel driver includes the data driver 110 and the gate driver 120. The display panel driver can further include the de-multiplexer array 112 between the data driver 110 and the data lines 102.

The de-multiplexer array 112 sequentially applies data voltages output from channels of the data driver 110 to the data lines 102 using a plurality of de-multiplexers (DEMUXs). The DEMUXs can include a number of switch elements on the display panel 100. When the DEMUXs are disposed between output terminals of the data driver 110 and the data lines 102, the number of channels of the data driver 110 can decrease. The de-multiplexer array 112 can be omitted.

The display panel driver can further include a touch sensor driver to drive the touch sensors. The touch sensor driver is omitted in FIG. 13. The data driver 110 and the touch sensor driver can be integrated into one drive integrated circuit (IC). In a mobile device or wearable device, the timing controller 130, the power supply 140, the data driver 110, etc. can be integrated into one drive IC.

The display panel driver can operate in a low-speed drive mode under control of the timing controller 130. The low-speed driving mode can be set to analyze an input image and reduce power consumption of the display device when a degree of change in the input image is less than a predetermined number of frames. In the low-speed driving mode, when still images are input for a certain time period or more, a refresh rate of pixels can be reduced to reduce power consumption of the display panel driver and the display panel 100. The low-speed driving mode is not limited to a case in which still images are input. For example, the display panel driver can operate in the low-speed driving mode when the display device operates in a standby mode or when a user command or an input image is not input to the display panel driver for a certain time.

The data driver 110 receives pixel data of an input image in the form of a digital signal from the timing controller 130 and outputs a data voltage. The data driver 110 generates a data voltage by converting pixel data of an input image into a gamma compensation voltage in each frame period using a digital-to-analog converter (DAC). The gamma reference voltage VGMA is divided into a gamma compensation voltage for each gradation through a voltage dividing circuit. A gamma compensation voltage for each gradation is provided to the DAC of the data driver 110. The data voltage is output through an output buffer in each channel of the data driver 110.

The gate driver 120 can be embodied as a gate-in-panel (GIP) circuit formed on the circuit layer 12 on the display panel 100, together with the TFT array and the interconnections of the pixel array. The gate driver 120 can be disposed on a bezel area BZ that is a non-display area of the display panel 100 or dispersed in the pixel array on which an input image is reproduced.

The gate driver 120 can, as shown in FIG. 13, be disposed in the bezel area BZ on one side of the display panel 100 and can supply a gate pulse [Gout(N)] to the gate lines 103 in a single feeding method. In addition, the gate driver 120 can be disposed in the bezel areas BZ on opposite sides of the display panel 100 with the pixel array interposed therebetween and can supply a gate pulse [Gout(N)] to the gate lines 103 in a double feeding method.

The gate driver 120 sequentially outputs the gate pulse [Gout(N)] to the gate lines 103 under the control of the timing controller 130. The gate driver 120 can shift the gate pulse [Gout(N)] by using a shift register to sequentially supply the gate pulse [Gout(N)] to the gate lines 103. The signal transmitter in the shift register can be implemented as the circuit described above. The gate driver 120 can include two or more shift registers, such as a shift register that generates a scan pulse, a shift register that generates a sensing pulse, a shift register that generates an initialization pulse, and a shift register that generates an emission control pulse (or EM pulse), and each of the shift registers can be implemented as the circuits employed in the above-described embodiments.

The timing controller 130 receives, from the host system, digital video data DATA of an input image and a timing signal synchronized with the digital video data. The timing signal can include a vertical synchronization signal Vsync, a horizontal synchronization signal Hsync, a clock CLK, and a data enable signal DE. Because a vertical period and a horizontal period can be known by counting the data enable signal DE, the vertical synchronization signal Vsync and the horizontal synchronization signal Hsync can be omitted. The data enable signal DE has a cycle of one horizontal period (1H).

The host system can be one of a television (TV) system, a tablet computer, a notebook computer, a navigation system, a personal computer (PC), a home theater system, a mobile device, a wearable device, and a vehicle system. The host system can scale the image signal from the video source to fit the resolution of the display panel 100, and can transmit it to the timing controller 130 together with the timing signal.

The timing controller 130 can multiply the input frame frequency by i (i is a natural number) in a normal driving mode, so that it can control the operation timing of the display panel driver at a frame frequency of the input frame frequency×i Hz. The input frame frequency is 60 Hz in the NTSC (National Television Standards Committee) system and 50 Hz in the PAL (Phase-Alternating Line) system.

In the low-speed driving mode, the timing controller 130 reduces a frequency of a frame rate at which pixel data is written to pixels, compared to a normal driving mode. For example, a data refresh frame frequency at which pixel data is written to pixels in the normal driving mode can occur at a refresh rate of 60 Hz or higher, e.g., any one of 60 Hz, 120 Hz or 144 Hz, and a data refresh frame DRF in the low-speed driving mode can occur at a refresh rate of a frequency lower than that in the normal driving mode. In order to lower the refresh rate of pixels in the low-speed driving mode, the timing controller 130 can reduce the driving frequency for the display panel driver by reducing the frame frequency to a frequency between 1 Hz and 30 Hz.

The timing controller 130 generates a data timing control signal for controlling the operation timing of the data driver 110 based on the timing signals Vsync, Hsync, and DE received from the host system, a control signal for controlling the operation timing of the de-multiplexer array 112, and a gate timing control signal for controlling the operation timing of the gate driver 120. The timing controller 130 synchronizes the data driver 110, the de-multiplexer array 112, the touch sensor driver, and the gate driver 120 by controlling the operation timing of the display panel driver.

The gate timing control signal generated from the timing controller 130 can be inputted to the shift registers of the gate driver 120 through a level shifter. The level shifter can receive the gate timing control signal and generate a start pulse and a shift clock to provide them to the shift registers of the gate driver 120.

The objects to be achieved by the present disclosure, the means for achieving the objects, and effects of the present disclosure described above do not specify essential features of the claims, and thus, the scope of the claims is not limited to the disclosure of the present disclosure.

Although the embodiments of the present disclosure have been described in more detail with reference to the accompanying drawings, the present disclosure is not limited thereto and can be embodied in many different forms without departing from the technical concept of the present disclosure. Therefore, the embodiments disclosed in the present disclosure are provided for illustrative purposes only and are not intended to limit the technical concept of the present disclosure. The scope of the technical concept of the present disclosure is not limited thereto.

Therefore, it should be understood that the above-described embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A gate driving circuit comprising:

a shift register including signal transmitters configured to receive a start pulse and a shift clock, the signal transmitters being connected in a cascade structure to sequentially generate a gate pulse, wherein an Nth signal transmitter among the signal transmitters includes:

a VST node to which the start pulse or a carry signal from a preceding signal transmitter is applied;

one or more CLK nodes to which the shift clock is inputted;

a VDD node to which a high-potential driving voltage is applied;

a VSS node to which a low-potential reference voltage is applied;

a first control node configured to control a first pull-up transistor;

a second control node configured to control a first pull-down transistor;

a first charge controller configured to charge the first control node in response to the voltage of the VST node;

a second charge controller configured to charge the second control node using a first transistor that is turned on in response to an (N+1)th clock generated following an Nth clock;

a first discharge controller configured to discharge the first control node in a charging period of the second control node; and a second discharge controller configured to discharge the second control node when the voltage of the VST node is a high voltage or during a charging period of the first control node, where N is a positive integer, wherein the shift clock includes:

the Nth clock inputted to a first CLK node, the (N+1)th clock inputted to a second CLK node following the Nth clock, and another dock inputted to a third CLK node following the (N+1)th clock, and wherein the low-potential reference voltage includes:

a first low-potential reference voltage applied to a first VSS node; and a second low-potential reference voltage set to be lower than the first low-potential reference voltage and applied to a second VSS node.

2. The gate driving circuit of claim 1, wherein the first transistor that is turned on in response to the (N+1)th clock generated following the Nth clock includes:

a gate electrode connected to the second CLK node, a first electrode connected to the VDD node, and a second electrode connected to the second control node.

3. The gate driving circuit of claim 2, wherein the second charge controller further includes:

an eleventh transistor including a gate electrode connected to the third CLK node, a first electrode connected to the VDD node, and a second electrode connected to the second control node.

4. The gate driving circuit of claim 3, wherein the first discharge controller includes:

a fifth transistor including a first gate electrode connected to the VST node, a second gate electrode connected to the second VSS node, a first electrode connected to the second control node, and a second electrode connected to the first VSS node; and a sixth transistor including a first gate electrode connected to the first control node, a second gate electrode connected to the second VSS node, a first electrode connected to the second control node, and a second electrode connected to the first VSS node.

5. The gate driving circuit of claim 1, further comprising:

a second pull-up transistor configured to be controlled by the first control node; and a second pull-down transistor configured to be controlled by the second control node, wherein the first pull-up transistor includes a gate electrode connected to the first control node, a first electrode connected to the first CLK node, and a second electrode connected to a first output node, the second pull-up transistor includes a gate electrode connected to the first control node, a first electrode connected to the first CLK node, and a second electrode connected to a second output node, the first pull-down transistor includes a gate electrode connected to the second control node, a first electrode connected to the first output node, and a second electrode connected to the first VSS node, and the second pull-down transistor includes a gate electrode connected to the second control node, a first electrode connected to the second output node, and a second electrode connected to the first VSS node.

6. The gate driving circuit of claim 1, wherein the first charge controller includes:

a second-first transistor including a gate electrode and a first electrode commonly connected to the VST node, and a second electrode connected to a buffer node;

a second-second transistor including a gate electrode connected to the VST node, a first electrode connected to the buffer node, and a second electrode connected to the first control node; and a third transistor including a gate electrode connected to the first control node, a first electrode connected to the VDD node, and a second electrode connected to the buffer node.

7. The gate driving circuit of claim 6, wherein the first discharge controller includes:

a fourth-first transistor including a gate electrode connected to the second control node, a first electrode connected to the first control node, and a second electrode connected to the buffer node; and a fourth-second transistor including a gate electrode connected to the second control node, a first electrode connected to the buffer node, and a second electrode connected to the first VSS node.

8. The gate driving circuit of claim 1, wherein the second discharge controller includes:

a fifth transistor including a first gate electrode connected to the VST node, a second gate electrode connected to the second VSS node, a first electrode connected to the second control node, and a second electrode connected to the first VSS node; and a sixth transistor including a first gate electrode connected to the first control node, a second gate electrode connected to the second VSS node, a first electrode connected to the second control node, and a second electrode connected to the first VSS node.

9. A display device comprising:

a display panel including data lines to which a data voltage is applied, gate lines crossing the data lines and to which a gate signal is applied, pixels connected to power lines, and a gate driving circuit configured to supply a gate pulse to the gate lines, wherein a shift register of the gate driving circuit includes signal transmitters configured to receive a start pulse and a shift clock and connected in a cascade structure, wherein an Nth signal transmitter among the signal transmitters includes:

a signal node to which the start pulse or a carry signal from a preceding signal transmitter is applied;

one or more shift clock nodes to which the shift clock is inputted;

a first voltage node to which a high-potential driving voltage is applied;

a second voltage node to which a low-potential reference voltage is applied;

a first control node configured to control a first pull-up transistor;

a second control node configured to control a first pull-down transistor;

a first charge controller configured to charge the first control node in response to the voltage of the signal node;

a second charge controller configured to charge the second control node using a first transistor that is turned on in response to an (N+1)th clock generated following an Nth clock;

a first discharge controller configured to discharge the first control node in a charging period of the second control node; and a second discharge controller configured to discharge the second control node when the voltage of the signal node is a high voltage or in a charging period of the first control node, where N is a positive integer, wherein the shift clock includes:

the Nth clock inputted to a first shift clock node, the (N+1)th clock inputted to a second shift clock node following the Nth clock; and an (N+2)th clock inputted to a third shift, clock node following the (N+1)th clock, and wherein the low-potential reference voltage includes:

a first low-potential reference voltage applied to a first VSS node; and a second low-potential reference voltage set to be lower than the first low-potential reference voltage and applied to a second VSS node.

10. The display device of claim 9, wherein the first transistor includes a gate electrode connected to the second shift clock node, a first electrode connected to the first voltage node, and a second electrode connected to the second control node.

11. The display device of claim 9, wherein the first charge controller includes:

a second-first transistor including a gate electrode and a first electrode commonly connected to the signal node, and a second electrode connected to a buffer node;

a second-second transistor including a gate electrode connected to the signal node, a first electrode connected to the buffer node, and a second electrode connected to the first control node; and a third transistor including a gate electrode connected to the first control node, a first electrode connected to the first voltage node, and a second electrode connected to the buffer node, and wherein the first discharge controller includes:

a fourth-first transistor including a gate electrode connected to the second control node, a first electrode connected to the first control node, and a second electrode connected to the buffer node; and a fourth-second transistor including a gate electrode connected to the second control node, a first electrode connected to the buffer node, and a second electrode connected to the first VSS node.

12. The display device of claim 9, wherein the second discharge controller includes:

a fifth transistor including a first gate electrode connected to the signal node, a second gate electrode connected to the second VSS node, a first electrode connected to the second control node, and a second electrode connected to the first VSS node; and a sixth transistor including a first gate electrode connected to the first control node, a second gate electrode connected to the second VSS node, a first electrode connected to the second control node, and a second electrode connected to the first VSS node.

13. The display device of claim 10, wherein the second charge controller further includes:

an eleventh transistor including a gate electrode connected to the third shift clock node, a first electrode connected to the first voltage node, and a second electrode connected to the second control node, wherein the first discharge controller includes:

a fifth transistor including a first gate electrode connected to the signal node, a second gate electrode connected to the second VSS node, a first electrode connected to the second control node, and a second electrode connected to the first VSS node; and a sixth transistor including a first gate electrode connected to the first control node, a second gate electrode connected to the second VSS node, a first electrode connected to the second control node, and a second electrode connected to the first VSS node.

14. The display device of claim 9, wherein a circuit layer of the display panel includes a pixel circuit of each of the pixels and the gate driving circuit, and wherein all transistors disposed in the circuit layer of the display panel are n-channel oxide thin film transistors (TFT) having a coplanar structure.

15. A display device comprising:

a display panel including data lines to which a data voltage is applied, gate lines crossing the data lines and to which a gate signal is applied, pixels connected to power lines, and a gate driving circuit configured to supply a gate pulse to the gate lines, wherein a shift register of the gate driving circuit includes signal transmitters configured to receive a start pulse and a shift clock and connected in a cascade structure, wherein an Nth signal transmitter among the signal transmitters includes:

a signal node to which the start pulse or a carry signal from a preceding signal transmitter is applied;

one or more shift clock nodes to which the shift clock is inputted;

a first voltage node to which a high-potential driving voltage is applied;

a second voltage node to which a low-potential reference voltage is applied;

a first control node configured to control a first pull-up transistor;

a second control node configured to control a first pull-down transistor;

a first charge controller configured to charge the first control node in response to the voltage of the signal node;

a second charge controller configured to charge the second control node using a first transistor that is turned on in response to an (N+1)th clock generated following an Nth clock;

a first discharge controller configured to discharge the first control node in a charging period of the second control node; and a second discharge controller configured to discharge the second control node when the voltage of the signal node is a high voltage or in a charging period of the first control node, where N is a positive integer, and wherein the second discharge controller includes:

a transistor including a gate electrode connected to the signal node, a first electrode connected to the second control node, and a second electrode connected to a second buffer node;

a transistor including a gate electrode connected to the signal node, a first electrode connected to the second buffer node, and a second electrode connected to the second voltage node;

a transistor including a gate electrode connected to the first control node, a first electrode connected to the second control node, and a second electrode connected to the second buffer node;

a transistor including a gate electrode connected to the first control node, a first electrode connected to the second buffer node, and a second electrode connected to the second voltage node; and a transistor including a gate electrode connected to the second control node, a first electrode connected to the second buffer node, and a second electrode to which the high-potential driving voltage is applied.

* * * * *